US006627590B1

(12) United States Patent
Sherry et al.

(10) Patent No.: US 6,627,590 B1
(45) Date of Patent: Sep. 30, 2003

(54) ACIDIC CLEANING COMPOSITIONS WITH $C_{10}$ ALKYL SULFATE DETERGENT SURFACTANT

(75) Inventors: Alan Edward Sherry, Cincinnati, OH (US); Nicola John Policicchio, Mason, OH (US); Jason Michael Knight, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/700,557

(22) PCT Filed: May 21, 1999

(86) PCT No.: PCT/US99/11248

§ 371 (c)(1),
(2), (4) Date: Nov. 16, 2000

(87) PCT Pub. No.: WO99/61569

PCT Pub. Date: Dec. 2, 1999

Related U.S. Application Data

(60) Provisional application No. 60/086,416, filed on May 22, 1998, and provisional application No. 60/100,875, filed on Sep. 17, 1998.

(51) Int. Cl.[7] ..... C11D 17/00

(52) U.S. Cl. ..... 510/238; 510/235; 510/426; 510/428; 510/432; 510/488; 510/506

(58) Field of Search ..... 510/235, 238, 510/426, 428, 432, 488, 566

(56) References Cited

U.S. PATENT DOCUMENTS

| | | | | |
|---|---|---|---|---|
| 3,970,594 A | * | 7/1976 | Claybaugh | 252/524 |
| 4,017,409 A | | 4/1977 | Demessemaekers et al. | |
| 5,403,515 A | | 4/1995 | Instone et al. | |
| 6,020,301 A | * | 2/2000 | Davister et al. | 510/417 |

FOREIGN PATENT DOCUMENTS

| | | |
|---|---|---|
| CA | 1204361 | 5/1986 |
| EP | 0105063 | 11/1984 |
| EP | 554 991 A1 | 8/1993 |
| EP | 639 833 A1 | 2/1995 |
| EP | 0805197 | 11/1997 |
| EP | 805 197 A1 | 11/1997 |
| EP | 916 718 A1 | 5/1999 |
| WO | WO 94/04644 | 3/1994 |
| WO | WO 96/34933 | 11/1996 |

* cited by examiner

*Primary Examiner*—Necholus Ogden
(74) *Attorney, Agent, or Firm*—Jason J. Camp; Kevin L. Waugh

(57) ABSTRACT

Compositions described herein are aqueous detergent compositions, preferably hard surface cleaning compositions, which contain $C_{10}$ alkyl sulfate detergent surfactant, optional hydrophobic cleaning solvent, optional, but preferred, mono- or poly-carboxylic acid, and optional, but preferred, aqueous solvent system, the pH being from about 2 to about 5. They have excellent soap scum removal and hard water deposit removal properties and are easy to rinse. Such compositions optionally contain additional cosurfactant, preferably anionic surfactant, peroxide and/or hydrophilic polymer for additional benefits. Articles of manufacture comprising the composition and a sprayer and methods of use are also disclosed.

21 Claims, No Drawings

ACIDIC CLEANING COMPOSITIONS WITH $C_{10}$ ALKYL SULFATE DETERGENT SURFACTANT

This Application claims benefit of Provisional applications No. 60/086,416 filed May 22, 1998 and Ser No. 60/100,875 filed Sep. 17, 1996.

FIELD OF THE INVENTION

This invention relates to liquid detergent compositions for use in cleaning hard surfaces, particularly bathroom surfaces. Such compositions typically contain detergent surfactants, solvents, builders, etc.

BACKGROUND OF THE INVENTION

The use of acidic detergent compositions comprising organic water-soluble synthetic detergent surfactants and cleaning solvents for cleaning hard surfaces in, e.g., bathrooms is well established. Known liquid detergent compositions for this purpose comprise organic cleaning solvents, detergent surfactants, and optional detergent builders and/or abrasives.

Liquid cleaning compositions are usually preferred, since they have the advantage that they can be applied to hard surfaces in neat or concentrated form so that a relatively high level of, e.g., surfactant material and/or organic solvent is delivered directly to the soil. However, solid compositions can also be used to form a cleaning solution when diluted with water. Concentrated liquid cleaning compositions have the potential to provide superior soap scum, grease, and oily soil removal as compared to dilute wash solutions, e.g., those typically prepared from powdered cleaning compositions.

The present invention provides preferred acidic hard surface cleaning compositions, preferably liquid, suitable for removal of soils commonly encountered in the bathroom, said compositions having specific surfactants, optional solvents, and, optionally, but preferably, organic acids. These acidic hard surface cleaning compositions remove soap scum and hard water marks. The compositions can have disinfectant properties achieved through the choice of antibacterial actives, including citric acid, and can be used with, or without, additives such as hydrogen peroxide for additional mold/mildew prevention benefits. Further, the compositions can advantageously incorporate one or more hydrophilic polymers for viscosity and/or improved surface wetting and/or filming/streaking properties.

SUMMARY OF THE INVENTION

The hard surface acidic detergent cleaning compositions herein comprise:

a. from about 0.1% to about 10% alkyl sulfate detergent surfactant, the alkyl group containing about 10 carbon atoms on the average, with substantially all of the alkyl groups having within two carbon atoms of the 10 average carbon atoms, and, preferably, the majority of the alkyl groups containing 10 carbon atoms;

b. optionally, an effective amount, e.g., from about 1% to about 8% of one, or more, organic cleaning solvents, preferably selected from the group consisting of: mono-propylene glycol mono-propyl ether, mono-propylene glycol mono-butyl ether; di-propylene glycol mono-propyl ether, di-propylene glycol mono-butyl ether; tn-propylene glycol mono-butyl ether; ethylene glycol mono-butyl ether; diethylene glycol mono-butyl ether, ethylene glycol mono-hexyl ether and diethylene glycol mono-hexyl ether, and mixtures thereof;

c. optionally, a minor amount that is preferably less than the amount of the said alkyl sulfate detergent surfactant, e.g., from about 0.25% to about 4%, of cosurfactant, preferably anionic and/or nonionic detergent surfactant, e.g., selected from the group consisting of: $C_8$–$C_{18}$ linear or branched alkylbenzene sulfonates; $C_8$–$C_{18}$ alkyl ethoxy sulfates; and mixtures thereof;

d. optionally, an effective amount, e.g., from about 1% to about 8% of water soluble mono- or polycarboxylic acid;

e. optionally, an effective amount, up to about 5%, of hydrogen peroxide;

f. optionally, an effective amount, up to about 1% of one, or more, quaternary ammonium surfactants;

g. optionally, from about 0.1% to about 1% of a thickening polymer selected from the group consisting of polyacrylates, gums and mixtures thereof, e.g., xanthan gum;

h. optionally, an effective amount, up to about 0.5%, of hydrophilic polymer other than said thickening polymer g., e.g., polymer selected from the group consisting of:; polystyrene sulfonate; polyvinyl pyrrolidone; polyvinyl pyrrolidone acrylic acid copolymer; polyvinyl pyridine; polyvinyl pyridine n-oxide; and mixtures thereof;

i. optionally, an effective amount of perfume and additional adjuvants; and j. optionally, but preferably, the balance being an aqueous solvent system, and wherein the cleaning compositions have a pH under usage conditions of from about 2 to about 5.

The improved cleaning is a direct result of the selection of the specific $C_{10}$ alkyl sulfate surfactant.

DETAILED DESCRIPTION OF THE INVENTION

The compositions of the invention are especially useful for cleaning the hard-to-remove soils that are commonly encountered in the bathroom. These include hard water stains, fatty acids, triglycerides, lipids, insoluble fatty acid soaps, and the like. The detergent compositions can be used on many different surface types, such as ceramic, fiber glass, polyurethane, and plastic surfaces.

a. The $C_{10}$ Alkyl Sulfate

The $C_{10}$ alkyl sulfate is an essential component of the invention. Such surfactants provide considerable performance and/or cost advantages versus other anionic surfactants. Suitable alkyl sulfates can be neutralized with an alkali metal base, preferably lithium, sodium, and/or potassium hydroxides, or can alternatively be neutralized with an ammonium or $C_1$–$C_9$ ammonium salt derivative such as mono-, di-, and/or tri-ethanol amine, diethylamine, tri-isopropanol amine, etc. wherein the nitrogen atom has from one to three substituents selected from alkyl and hydroxy-alkyl groups containing from one to about four carbon atoms. The alkyl sulfates can be produced via any suitable process. Such surfactants are commercially available from several suppliers globally, including Witco Corporation (One American Lane, Greenwich, Conn. 06831), Stepan Company (Edens & Witnetka Rd, Northfield, Ill. 60093) and Imperial Chemical Industries (Concord Plaza, 3411 Silverside Rd PO Box 15391, Wilmington, Del. 19850-5391).

The usage detergent compositions according to the present invention are prepared with relatively low levels of active. Typically, compositions will comprise sufficient surfactant and optional solvent, as discussed hereinafter, to be effective as hard surface cleaners yet remain economical; accordingly they typically contain from about 0.5% to about 5% $C_{10}$ alkyl sulfate surfactant, more preferably from about 1% to about 4% $C_{10}$ alkyl sulfate surfactant, and even more preferably from about 1.2% to about 3% $C_{10}$ alkyl sulfate surfactant. It has been found that low levels of $C_{10}$ alkyl sulfate surfactant can be advantageous to overall cleaning performance. In the context of thickened compositions the alkyl sulfate surfactant also helps provide improved phase stability.

The alkyl sulfates of the invention have a chain length average of about 10 carbon atoms. The chain length distribution can vary from about 8 carbon atoms to about 12 carbons. However, the preferred alkyl sulfates are those that contain mostly $C_{10}$ alkyl sulfates.

Ammonium and sodium salts of $C_{10}$ alkyl sulfates are most preferred in the context of the present invention. Examples of particularly preferred, commercially available sodium $C_{10}$ alkyl sulfates include Polystep B25 from Stepan and Empicol 0137 from ICI. Alternatively, the desired $C_{10}$ alkyl sulfate surfactant can be produced in-situ by neutralization of the corresponding $C_{10}$ alkyl sulfuric acid.

b. The Optional Organic Cleaning Solvent

The compositions, optionally, can also contain one, or more, organic cleaning solvents at effective levels, typically no less than about 0.5%, and, at least about, in increasing order of preference, about 1% and about 2%, and no more than about, in increasing order of preference, about 8% and about 6% by weight of the composition.

The essential $C_{10}$ alkyl sulfate surfactant provides exceptional cleaning even when there is no hydrophobic cleaning solvent present. However, the good cleaning can normally be further improved by the use of the right organic cleaning solvent. By organic cleaning solvent, it is meant an agent which assists the surfactant to remove soils such as those commonly encountered in the bathroom. The organic cleaning solvent also can participate in the building of viscosity, if needed, and in increasing the stability of the composition. The compositions containing $C_{10}$ alkyl sulfates also have lower sudsing characteristics when the solvent is present. Thus, the suds profile can be controlled in large part by simply controlling the level of hydrophobic organic cleaning solvent in the formulation. Additionally, it is found that organic solvents facilitate the rinsing of compositions comprising $C_{10}$AS. It is believed that the rinse benefits follow from lower suds level and that organic solvents suppress suds in an analogous manner to silicone oils, by occupying sites at the air-water interface while not being surface active. Thus, more hydrophobic solvents such as dipropylene glycol butyl ether are stronger suds suppressors than less hydrophobic solvents such as propylene glycol butyl ether.

Such solvents typically have a terminal $C_3$–$C_6$ hydrocarbon attached to from one to three ethylene glycol or propylene glycol moieties to provide the appropriate degree of hydrophobicity and, preferably, surface activity. Examples of commercially available hydrophobic cleaning solvents based on ethylene glycol chemistry include mono-ethylene glycol n-hexyl ether (Hexyl Cellosolve® available from Union Carbide). Examples of commercially available hydrophobic cleaning solvents based on propylene glycol chemistry include the di-, and tri-propylene glycol derivatives of propyl and butyl alcohol, which are available from Arco Chemical, 3801 West Chester Pike, Newtown Square, Pa. 19073) and Dow Chemical (1691 N. Swede Road, Midland, Mich.) under the trade names Arcosolv® and Dowanol®.

In the context of the present invention, preferred solvents are selected from the group consisting of mono-propylene glycol mono-propyl ether, mono-propylene glycol mono-butyl ether di-propylene glycol mono-propyl ether , di-propylene glycol mono-butyl ether; tri-propylene glycol mono-butyl ether; ethylene glycol mono-butyl ether; di-ethylene glycol mono-butyl ether, ethylene glycol mono-hexyl ether and di-ethylene glycol mono-hexyl ether, and mixtures thereof. "Butyl" includes both normal butyl, isobutyl and tertiary butyl groups. Di-propylene glycol mono-butyl ether is most preferred cleaning solvent and is available under the trade names Arcosolv DPnB® and Dowanol DPnB®. Di-propylene glycol mono-t-butyl ether is commercially available from Arco Chemical under the tradename Arcosolv PTB®.

The amount of organic cleaning solvent can vary depending on the amount of other ingredients present in the composition. The hydrophobic cleaning solvent is normally helpful in providing good cleaning.

c. The Additional Cosurfactant

The detergent compositions of the present invention optionally can include a small amount of additional anionic and/or nonionic detergent surfactant, preferably anionic, cosurfactant. Such anionic surfactants typically comprise a hydrophobic chain containing from about 8 carbon atoms to about 18, preferably from about 10 to about 16, carbon atoms, and typically include a sulfonate or carboxylate hydrophilic head group. Examples of suitable preferred anionic cosurfactants include other linear or branched alkyl sulfate detergent surfactants (e.g., Stepanol AM® from Stepan), alkyl ethoxy sulfates (Witconate 7093® from Witco corporation, One American Lane, Greenwich, Conn.). In general, the level of optional, e.g., anionic, surfactants in the compositions herein is from about 0.25% to about 4%, more preferably from about 0.5% to about 3.5%, most preferably from about 0.75% to about 3%, by weight of the composition.

Other additional anionic surfactants include paraffin sulfonates (Hostapur SAS® from Hoechst, Aktiengesellschaft, D-6230 Frankfurt, Germany) and alkyl ethoxy carboxylates detergent surfactant (Neodex® from Shell Chemical Corporation).

Nonionic detergent surfactants can also be present. Suitable nonionic detergent surfactants for use herein are alkoxylated alcohols generally comprising from about 6 to about 16 carbon atoms in the hydrophobic alkyl chain of the alcohol. Typical alkoxylation groups are ethoxy and/or propoxy groups. Such compounds are commercially available under the series Neodol® from Shell, or Lutensol® from BASF AG with a wide variety of chain length and alkoxylation degrees. Preferred nonionic detergent surfactants for use herein are according to the formula $R(X)_nH$, were R is an alkyl chain having from about 6 to about 16 carbon atoms, preferably from about 6 to about 10, X is an alkoxy group, preferably ethoxy, or a mixture of ethoxy and propoxy groups, n is an integer of from about 4 to about 30 preferably about 5 to about 8. Other non-ionic surfactants that can be used include those derived from natural sources such as sugars and include $C_8$–$C_{16}$ alkyl polyglucosides (e.g., Simusol® surfactants from Seppic Corporation, 75 Quai d'Orsay, 75321 Paris, Cedex 7, France) and $C_8$–$C_{16}$ N-alkyl glucose amide surfactants. If present, the concentration of nonionic surfactant is from about 0.1% to about 3%, more preferably from about 0.1% to about 2%, by weight of the composition.

d. The Mono- or Polycarboxylic Acid

For purposes of soap scum and hard water stain removal, the compositions are acidic with a pH of from about 2 to about 5, more preferably about 3. Acidity is accomplished, at least in part, through the use of one or more organic acids that have a pKa of less than about 5, preferably less than about 4. Such organic acids also can assist in phase formation for thickening, if needed, as well as provide hard water stain removal properties. It is found that organic acids are very efficient in promoting good hard water removal properties within the framework of the compositions of the present invention. Lower pH and use of one or more suitable acids is also found to be advantageous for disinfectancy benefits.

Examples of suitable mono-carboxylic acids include acetic acid, glycolic acid or β-hydroxy propionic acid and the like. Examples of suitable polycarboxylic acids include citric acid, tartaric acid, succinic acid, glutaric acid, adipic acid, and mixtures thereof. Such acids are readily available in the trade. Examples of more preferred polycarboxylic acids include citric acid (available from Aldrich Corporation, 1001 West Saint Paul Avenue, Milwaukee, Wis.) and a mixture of succinic, glutaric and adipic acids available from DuPont (Wilmington, Del.) sold as "refined AGS di-basic acids". Citric acid is most preferred, particularly for cleaning soap scum. Glycolic acid and the mixture of adipic, glutaric and succinic acids provide greater benefits for hard water stain removal. The amount of organic acid in the compositions herein can be from about 1% to about 10%, more preferably from about 2% to about 8%, most preferably from about 3% to about 6% by weight of the composition.

e. Optional Source of Peroxide

The compositions of the invention can contain peroxide such as hydrogen peroxide, or a source of hydrogen peroxide, for further disinfectancy, fungistatic and fungicidal benefits. Peroxide is believed to enhance the longevity of the benefit because of its well known residuality and slow decomposition to produce free radical species. The components of the present composition are substantially compatible with the use of peroxides. Preferred peroxides include benzoyl peroxide and hydrogen peroxide. These can optionally be present in the compositions herein in levels of from about 0.05% to about 5%, more preferably from about 0.1% to about 3%, most preferably from about 0.2% to about 1.5%.

When peroxide is present, it is desirable to provide a stabilizing system. Suitable stabilizing systems are known. A preferred stabilizing system consists of radical scavengers and/or metal chelants present at levels of from about 0.01% to about 0.5%, more preferably from about 0.01% to about 0.25%, most preferably from about 0.01% to about 0.10%, by weight of the composition. Examples of radical scavengers include anti-oxidants such as propyl gallate, butylated hydroxy toluene (BHT), butylated hydroxy anisole (BHA) and the like. Examples of suitable metal chelants include diethylene triamine penta-acetate, diethylene triamine penta-methylene phosphonate, hydroxyethyl diphosphonate and the like.

f. Optional Quaternary Surfactant

Incorporation of quaternary ammonium surfactants is particularly preferred for compositions intended to deliver antibacterial, fungistatic and fungicidal properties. Quaternary ammonium surfactants are known in the art and include $C_{10-16}$ alkyl trimethyl ammonium, $C_{8-14}$ dialkyl dimethyl ammonium and $C_{10-16}$ alkyl dimethylbenzyl ammonium derivatives and mixtures thereof. Suitable and commercially available $C_{10-16}$ alkyl trimethyl ammonium and $Cr_{8-14}$ dialkyl dimethyl ammonium quaternaries are available from Witco corporation under the tradename Adogen®; suitable $C_{10-16}$ alkyl dimethylbenzyl ammonium surfactants may be purchased from Lonza incorporated under the tradename Bardac®. Quaternary ammonium surfactants are preferably present in no greater than about 2%, more preferably no greater than about 1.5%, most preferably no greater than about 1% by weight of the composition.

g. Optional Thickening Polymer

Low levels of polymer can also be used to thicken the compositions of the present invention. Thick bathroom cleaner compositions are desired in geographies where the use of sprayers is not commonplace. Generally, a Brookfield viscosity (spindle #2, 60 rpm) of from about 80 cP to about 1,000 cP is desired. Polymers such as high molecular weight acrylates or gums are particularly suitable for this purpose. Xanthan gum is a particularly preferred thickening agent. The thickening polymer agent is present at a level of from about 0.10% to about 1.0%, more preferably from about 0.12% to about 0.75%, most preferably from about 0.15% to about 0.5% by weight of the composition. For markets where spray products are commonplace, vertical cling of the product sprayed on surfaces is desirable. It is noted that the compositions of the present invention display excellent vertical cling properties, even in the absence of high molecular weight polymers. Moreover, vertical cling can be improved further through the use of very low levels of such polymers. Additional benefits realized through polymeric gums include improved suds stability and a reduction of product irritation when sprayed. In the context of spray applications, use of up to about 0.10% polymeric gum, such as xanthan gum or guar gum, has been found to be highly beneficial. Use of very low levels of the polymer limits the potential rinsing negatives that can be observed at higher levels of polymer.

h. Optional Hydrophilic Polymer

In a preferred embodiment, the compositions of the present invention can advantageously incorporate low levels of hydrophilic polymer. These polymers have been found to enhance water sheeting on surfaces and improve filming streaking. It is believed that such polymers hydrophilically modify ceramic surface thereby reducing water surface tension and inducing improved water sheeting on said surfaces. This sheeting effect allows for channeling of dissolved soils down shower walls in bathrooms, leading to lower residual soil levels.

Hydrophilic polymers have also been shown to mitigate the surface spotting caused by surfactants, especially for compositions that additionally include quaternary ammonium surfactant.

Preferred hydrophilic polymers to be used in conjunction with compositions of the present invention include:, polystyrene sulfonate, polyvinyl pyrrolidone, polyvinyl pyrrolidone/acrylate copolymer, polyvinyl pyridine and polyvinyl pyridine n-oxide. For compositions that include optional hydrogen peroxide, the most preferred polymers are polyvinyl pyridine and polyvinyl pyridine n-oxide. The preferred polymers, if present, have an average molecular weight of from about 10,000 to about 5,000,000, more preferably from about 20,000 to about 1,000,000, most preferably from about 30,000 to about 500,000. The level of polymer desired to achieve the desired benefits is from about 0.001% to about 0.10%, more preferably from about 0.005% to about 0.075%, most preferably from about 0.01% to about 0.05%. The specific level of polymer depends on the formulator's objective. Thus, while improved sheeting results from increased level of polymer, it is also found that hard water removal performance deteriorates.

i. The Optional Aqueous Solvent System

The compositions which are aqueous, comprise at least about 60% aqueous solvent by weight of the composition, more preferably from about 60% to about 90% by weight of the composition. The aqueous compositions typically contain the detergent surfactants in micellar form, and do not incorporate substantial levels of water insoluble components that induce significant micellar swelling; the compositions are preferably adjusted to a final pH of from about 2 to about 5, more preferably about 3.

The aqueous solvent system can also comprise low molecular weight, highly water soluble solvents typically found in detergent compositions, e.g., ethanol, isopropanol, etc.

The compositions of the present invention can also include other solvents, and in particular paraffins and isoparaffins, which can substantially reduce the suds created by the composition.

j. Optional Perfume and Additional Adjuvants

Optional components, such as perfumes and other conventional adjuvants can also be present.

Perfume

An optional, but highly preferred ingredient, is perfume, usually a mixture of perfume ingredients. Indeed, perfume ingredients, which are typically hydrophobic materials, have been found to provide a contribution to building viscosity, perhaps through supporting the phase structure of the product, as well as improving the overall stability of the product. As used herein, perfume includes constituents of a perfume which are added primarily for their olfactory contribution.

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface.

The perfumes are preferably those that are more water-soluble and/or volatile to minimize spotting and filming. The perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said patent, and especially said specific portion, being incorporated by reference.

Perfume components can be natural products such as essential oils, absolutes, resinoids, resins, concretes, etc., and/or synthetic perfume components such as hydrocarbons, alcohols, aldehydes, ketones, ethers, acids, acetals, ketals, nitrites, etc., including saturated and unsaturated compounds, aliphatic, carbocyclic and heterocyclic compounds. Examples of such perfume components are: geraniol, geranyl acetate, linalool, linalyl acetate, tetrahydrolinalool, citronellol, citronellyl acetate, dihydromyrcenol, dihydromyrcenyl acetate,, terpineol, terpinyl acetate, acetate, 2-phenylethanol, 2-phenylethyl acetate, benzyl alcohol, benzyl acetate, benzyl salicylate, benzyl benzoate, styrallyl acetate, amyl salicylate, dimenthylbenzylcarbinol, trichloromethylphenycarbinyl acetate, p-tert.butyl-cyclohexyl acetate, isononyl acetate, alpha-n-amylcinammic aldehyde, alpha-hexyl-cinammic aldehyde, 2-methyl-3-(p-tert.butylphenyl)-propanal, 2-methyl-3(p-isopropylphenyl)propanal, 3-(p-tert.butylphenyl)propanal, tricyclodecenyl acetate, tricyclodecenyl propionate, 4-(4-hydroxy4-methylpentyl)-3-cyclohexenecarbaldehyde, 4-(4-methyl-3-pentenyl)-3cyclohexenecarbaldehyde, 4-acetoxy-3-pentyl-tetrahhydropyran, methyl dihydrojasmonate, 2-n-heptyl-cyclopentanone, 3-methyl-2-pentyl-cyclopentanone, n-decanal, n-dodecanal, 9-decenol-1, phenoxyethyl isobutyrate, phenylacetaldehyde dimenthyl acetal, phenylacetaldehyde dicetyll acetal, geranonitrile, citronellonitrile, cedryl acetate, 3-isocamphyl-cyclohexanol, cedryl ether, isolongifolanone, aubepine nitrile, aubepine, heliotropine, coumarin, eugenol, vanillin, diphenyl oxide, hydroxycitronellal, ionones, methyl ionones, isomethyl ionones, irones, cis-3-hexenol and esters thereof, indane musks, tetralin musks, isochroman musks, macrocyclic ketones, macrolactone musks, ethylene brassylate, aromatic nitromusk. Compositions herein typically comprise from 0.1% to 2% by weight of the total composition of a perfume ingredient, or mixtures thereof, preferably from 0.1% to 1.0%. In the case of the preferred embodiment containing peroxide, the perfumes must be chosen so as to be compatible with the oxidant.

In a preferred execution, the perfume ingredients are hydrophobic and highly volatile, e.g., ingredients having a boiling point of less than about 260° C., preferably less than about 255° C.; and more preferably less than about 250° C., and a ClogP of at least about 3, preferably more than about 3.1, and even more preferably more than about 3.2.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.-Chim. Theor., 19, 71 (1984).

The compositions herein can comprise a variety of other optional ingredients, including further actives and detergent builder, as well as mere aesthetical ingredients.

In particular the rheology of the compositions herein can be made suitable for suspending particles in the composition, e.g., particles of abrasives.

Detergent builders that are efficient for hard surface cleaners and have reduced filming/streaking characteristics at the critical levels are another optional ingredient. Preferred detergent builders are the carboxylic acid detergent builders described hereinbefore as part of the polycarboxylic acid disclosure, including citric and tartaric acids. Tartaric acid improves cleaning and can minimize the problem of filming/streaking that usually occurs when detergent builders are added to hard surface cleaners.

The detergent builder is present at levels that provide detergent building, and, those that are not part of the acid pH adjustment described hereinbefore, are typically present at a level of from about 0.1% to about 0.3%. more preferably from about 0.2% to about 2%, and most preferably from about 0.5 to about 1%.

The compositions herein can also contain other various adjuncts which are known to the art for detergent compositions. Preferably they are not used at levels that cause unacceptable filming/streaking.

Non-limiting examples of other adjuncts are: enzymes such as proteases; hydrotropes such as sodium toluene sulfonate, sodium cumene sulfonate and potassium xylene sulfonate; thickeners other than the hydrophilic polymers at a level of from about 0.01% to about 0.5%, preferably from about 0.05% to about 0.4%; and aesthetic-enhancing ingredients such as colorants, providing they do not adversely impact on filming/streaking.

Antibacterial agents can be present, but preferably only at levels below about 0.5%, preferably below about 0.4%, to avoid filming/streaking problems. More hydrophobic antibacterial/germicidal agents, like orthobenzyl-para-chlorophenol, are avoided. If present, such materials should preferably be kept at levels below about 0.1%.

Making Processes

The compositions herein can be made by mixing together all ingredients. In general, a preferred order of addition is to first incorporate water, $C_{10}$ alkyl sulfate detergent surfactant and organic acid, followed by any hydrophobic cleaning solvent. Once the solvent is added, pH is adjusted to optimum as desired by the formulator. Optional, peroxide, polymer, perfume and dye can then be added.

Spray Dispenser

The article of manufacture herein comprises the composition in a spray dispenser. The acidic cleaning composition is placed into a spray dispenser in order to be distributed onto the surface that is to be cleaned. Said spray dispenser is preferably any of the manually activated means for producing a spray of liquid droplets as is known in the art, e.g. trigger-type, pump-type, non-aerosol self-pressurized, and aerosol-type spray means. The spray dispenser herein does not normally include those that will substantially foam the acidic cleaning composition. Performance is increased by providing smaller particle droplets. Desirably, the Sauter mean particle diameter is from about 10 $\mu$m to about 120 $\mu$m, more preferably, from about 20 $\mu$m to about 100 $\mu$m. A degree of foam and/or resistance to drainage, as discussed hereinbefore, can provide improved acceptance.

The spray dispenser can be an aerosol dispenser. Said aerosol dispenser, however, must comprises a container which can withstand acidic conditions. The dispenser must be capable of withstanding internal pressure in the range of from about 20 to about 110 p.s.i.g., more preferably from about 20 to about 70 p.s.i.g. The aerosol dispenser utilizes a pressurized sealed container from which the acidic cleaning composition is dispensed through a special actuator/valve assembly under pressure. The aerosol dispenser is pressurized by incorporating therein a gaseous component generally known as a propellant. Common aerosol propellants, e.g., gaseous hydrocarbons such as isobutane, and mixed halogenated hydrocarbons, which are not preferred. Halogenated hydrocarbon propellants such as chlorofluoro hydrocarbons have been alleged to contribute to environmental problems. Hydrocarbon propellants can be ignited. Preferred propellants are compressed air, nitrogen, inert gases, carbon dioxide, etc. A more complete description of commercially available aerosol-spray dispensers appears in U.S. Pat. No. : 3,436,772, Stebbins, issued Apr. 8, 1969; and U.S. Pat. No. 3,600,325, Kaufman et al., issued Aug. 17, 1971; both of said references are incorporated herein by reference.

The spray dispenser can be a self-pressurized non-aerosol container having a convoluted liner and an elastomeric sleeve. Said self-pressurized dispenser comprises a liner/sleeve assembly containing a thin, flexible radially expandable convoluted plastic liner of from about 0.010 to about 0.020 inch thick, inside an essentially cylindrical elastomeric sleeve. The liner/sleeve is capable of holding a substantial quantity of odor-absorbing fluid product and of causing said product to be dispensed. A more complete description of self-pressurized spray dispensers can be found in U.S. Pat. No. 5,111,971, Winer, issued May 12, 1992, and U.S. Pat. No. 5,232,126, Winer, issued Aug. 3, 1993; both of said references are herein incorporated by reference. Another type of aerosol spray dispenser is one wherein a barrier separates the acidic cleaning composition from the propellant (preferably compressed air or nitrogen), as disclosed in U.S. Pat. No. 4,260,110, issued Apr. 7, 1981, and incorporated herein by reference. Such a dispenser is available from EP Spray Systems, East Hanover, N.J.

More preferably, the spray dispenser is a non-aerosol, manually activated, pump-spray dispenser. Said pump-spray dispenser comprises a container and a pump mechanism which securely screws or snaps onto the container. The container comprises a vessel for containing the acidic cleaning composition.

The pump mechanism comprises a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof.

The container and the pump mechanism can be constructed of any conventional material employed in fabricating pump-spray dispensers, including, but not limited to: polyethylene; polypropylene; polyethyleneterephthalate; blends of polyethylene, vinyl acetate, and rubber elastomer. A preferred container is made of clear, e.g., polyethylene terephthalate. Other materials can include stainless steel that is resistant to acid and/or glass. A more complete disclosure of commercially available dispensing devices appears in: U.S. Pat. No. 4,895,279, Schultz, issued Jan. 23, 1990; U.S. Pat. No. 4,735,347, Schultz et al., issued Apr. 5, 1988; and U.S. Pat. No. 4,274,560, Carter, issued Jun. 23, 1981; all of said references are herein incorporated by reference.

Most preferably, the spray dispenser is a manually activated trigger-spray dispenser. Said trigger-spray dispenser comprises a container and a trigger both of which can be constructed of any of the conventional material employed in fabricating trigger-spray dispensers, including, but not limited to: polyethylene; polypropylene; polyacetal; polycarbonate; polyethyleneterephthalate; polyvinyl chloride; polystyrene; blends of polyethylene, vinyl acetate, and rubber elastomer. Other materials can include stainless steel that is resistant to attack by acid and/or glass. The trigger-spray dispenser does not incorporate a propellant gas into the odor-absorbing composition. The trigger-spray dispenser herein is typically one which acts upon a discrete amount of the acidic cleaning composition itself, typically by means of a piston or a collapsing bellows that displaces the composition through a nozzle to create a spray of thin liquid. Said trigger-spray dispenser typically comprises a pump chamber having either a piston or bellows which is movable through a limited stroke response to the trigger for varying the volume of said pump chamber. This pump chamber or bellows chamber collects and holds the product for dispensing. The trigger spray dispenser typically has an outlet check valve for blocking communication and flow of fluid through the nozzle and is responsive to the pressure inside the chamber. For the piston type trigger sprayers, as the trigger is compressed, it acts on the fluid in the chamber and the spring, increasing the pressure on the fluid. For the bellows spray dispenser, as the bellows is compressed, the pressure increases on the fluid. The increase in fluid pressure in either trigger spray dispenser acts to open the top outlet check valve. The top valve allows the product to be forced through the swirl chamber and out the nozzle to form a discharge pattern. An adjustable nozzle cap can be used to vary the pattern of the fluid dispensed.

For the piston spray dispenser, as the trigger is released, the spring acts on the piston to return it to its original position. For the bellows spray dispenser, the bellows acts as the spring to return to its original position. This action causes a vacuum in the chamber. The responding fluid acts to close the outlet valve while opening the inlet valve drawing product up to the chamber from the reservoir.

A more complete disclosure of commercially available dispensing devices appears in U.S. Pat. No. 4,082,223, Nozawa, issued Apr. 4, 1978; U.S. Pat. No. 4,161,288, McKinney, issued Jul. 17, 1985; U.S. Pat. No. 4,434,917, Saito et al., issued Mar. 6, 1984; and U.S. Pat. No. 4,819,835, Tasaki, issued Apr. 11, 1989; U.S. Pat. No. 5,303,867, Peterson, issued Apr. 19, 1994; all of said references being incorporated herein by reference.

A broad array of trigger sprayers or finger pump sprayers are suitable for use with the compositions of this invention. These are readily available from suppliers such as Calmar, Inc., City of Industry, Calif.; CSI (Continental Sprayers, Inc.), St. Peters, Mo.; Berry Plastics Corp., Evansville, Ind., a distributor of Guala® sprayers; or Seaquest Dispensing, Cary, Ill.

The preferred trigger sprayers are the blue inserted Guala® sprayer, available from Berry Plastics Corp., or the Calmar TS800-1A®, TS1300®, and TS-800-2®, available from Calmar Inc., because of the fine uniform spray characteristics, spray volume, and pattern size. More preferred are sprayers with precompression features and finer spray characteristics and even distribution, such as Yoshino sprayers from Japan. Any suitable bottle or container can be used with the trigger sprayer, the preferred bottle is a 17 fl-oz. bottle (about 500 ml) of good ergonomics similar in shape to the Cinch® bottle. It can be made of any materials such as high density polyethylene, polypropylene, polyvinyl chloride, polystyrene, polyethylene terephthalate, glass, or any other material that forms bottles. Preferably, it is made of high density polyethylene or clear polyethylene terephthalate.

For smaller fluid ounce sizes (such as 1 to 8 ounces), a finger pump can be used with canister or cylindrical bottle. The preferred pump for this application is the cylindrical Euromist II® from Seaquest Dispensing. More preferred are those with precompression features.

As used herein, all numerical values are approximations based upon normal variations; all parts, percentages, and ratios are by weight unless otherwise specified; and all patents and other publications referred to herein are incorporated herein by reference.

Soap Scum Cleaning: Standard soiled plates that are used to provide a reproducible, standard soiled surface are treated with each product and the surface is then wiped with a sponge using a Gardner Straight line Washability Machine. The number of strokes required for complete cleaning is measured and recorded. Compositions which do not clean the soiled plates in 50 strokes are assigned a stroke count of 50+.

Hard Water Cleaning: Four marble chips for each product tested of approximate dimensions ¾"×¾"×¼" are weighed to four decimal places using an analytical balance. The chips are then placed in 100 ml beakers containing 20 grams of product for a total of 10 minutes. The marble chips are then removed, rinsed and allowed to dry. They are then re-weighed and the weight lost is computed. Using averages of four trials for each product, the hard water removal index is computed as follows: (average weight loss of the marble chips immersed in the control product/average weight loss of the marble chips immersed in the experimental compositions)*100.

The compositions below were tested versus Dow Bath Room aerosol®, the leading bath room cleaner in the US. Tests included an evaluation of hard water performance and soap scum. For reference, Dow Bath Room aerosol removed soap scum in 30 strokes and also removed 10 mg $CaCO_3$ using the chip test.

Ease of Rinse Test

This test measures the ease with which cleaning compositions are rinsed. Five ml of product are evenly placed in a sink and cleaning is simulated by rubbing the product on the surface with a sponge at a constant pressure. The resulting foam is then washed away using 7 grain per gallon water and the amount of water necessary to completely rinse the product down the sink is obtained by collecting the water underneath the sink in a large beaker and measuring volume. Collection of the product beneath the sink also allows for the suds level to be quantified by measuring the suds height above the collected solution

EXAMPLES

The present invention is further illustrated by the following examples and comparative examples. The following compositions are made by mixing the listed ingredients in the listed proportions in the listed order of addition.

Composition

Effect of Anionic Surfactant Type

The effect of anionic surfactant type was evaluated in the context of formulations comprising:

2.0% anionic surfactant 3.0% citric acid 0.16% ammonium hydroxide 0.2% perfume:

The following surfactants were found to not fully remove the soap scum from the test plates even after cleaning for 50 strokes:

| | |
|---|---|
| $C_6$ diphenyl ether disulfonate | $C_{12}$ alkyl benzene sulfonate |
| $C_{10}$ diphenyl ether disulfonate | $C_{14-17}$ paraffin sulfonate |
| $C_{12}$ diphenyl ether disulfonate | $C_{10}$ ethoxylated (2) sulfate |
| $C_{16}$ diphenyl ether disulfonate | $C_{12}$ ethoxylated (2) sulfate |
| $C_{14-16}$ olefin sulfonate | $C_{12}$ ethoxylated (3) sulfate |

The above data suggested poor cleaning performance for ethoxylated sulfates, paraffin and benzene sulfonates. The cleaning results are in contrast to those obtained for $C_{10}$ alkyl sulfates shown below:

Effect of Alkyl Sulfate Chain Length

| | 1 | 2 | 3 | 4 | 5 | 6 | 7 |
|---|---|---|---|---|---|---|---|
| Ingredient | | | | | | | |
| $C_8$ alkyl sulfate | 2.0 | — | — | — | 1.0 | — | 1.0 |
| $C_{10}$ alkyl sulfate* | — | 2.0 | — | — | 1.0 | 1.0 | — |
| $C_{12}$ alkyl sulfate*** | — | — | 2.0 | — | — | 1.0 | 1.0 |
| $C_{12-14}$ alkyl sulfate**** | — | — | — | 2.0 | — | — | — |
| Citric acid# | 3.0 | 3.0 | 3.0 | 3.0 | 3.0 | 3.0 | 3.0 |
| $NH_4OH$ | 0.16 | 0.16 | 0.16 | 0.16 | 0.16 | 0.16 | 0.16 |
| Perfume | 0.2 | 0.2 | 0.2 | 0.2 | 0.2 | 0.2 | 0.2 |
| Water | Bal. | Bal. | Bal. | Bal. | Bal. | Bal. | Bal. |
| Performance test | | | | | | | |
| Soap scum (strokes to clean) | 50+ | 11 | 21 | 50+ | 13 | 12 | 17 |
| Calcium chip removal (mg) | 41 | 33 | 39 | 34 | 44 | 44 | 42 |

The data suggest that soap scum cleaning performance is very sensitive to alkyl sulfate chain length, with the best results achieved at $C_{10}$ AS. Excellent cleaning can also be achieved using combinations of alkyl sulfate surfactant that include $C_{10}$ AS or by combinations of alkyl sulfates that do not include $C_{10}$ AS, but that average about 10 carbon atoms. Combinations of surfactants with $C_{10}$ AS also deliver excellent removal of calcium carbonate as measured by the calcium chip test.

Effect of Solvent on AS Soap Scum Cleaning

| | 1 | 8 | 9 | 2 | 10 | 11 | 3 | 12 | 13 |
|---|---|---|---|---|---|---|---|---|---|
| Ingredient | | | | | | | | | |
| $C_8$ alkyl sulfate* | 2.0 | 2.0 | 2.0 | — | — | — | — | — | — |
| $C_{10}$ alkyl sulfate** | — | — | — | 2.0 | 2.0 | 2.0 | — | — | — |
| $C_{12}$ alkyl sulfate*** | — | — | — | — | — | — | 2.0 | 2.0 | 2.0 |
| Citric acid# | 3.0 | 3.0 | 3.0 | 3.0 | 3.0 | 3.0 | 3.0 | 3.0 | 3.0 |
| $NH_4OH$ | 0.16 | 0.16 | 0.16 | 0.16 | 0.16 | 0.16 | 0.16 | 0.16 | 0.16 |
| DPnB†† | — | 2.0 | 4.0 | — | 2.0 | 4.0 | — | 2.0 | 4.0 |
| Perfume | 0.2 | 0.2 | 0.2 | 0.2 | 0.2 | 0.2 | 0.2 | 0.2 | 0.2 |
| Water | Bal. | Bal. | Bal. | Bal. | Bal. | Bal. | Bal. | Bal. | Bal. |
| Performance data | | | | | | | | | |
| Soap scum (strokes) | 50+ | 50+ | 50+ | 11 | 7 | 6 | 20 | 13 | 9 |
| Hard water (mg) | 41 | 47 | 47 | 33 | 45 | 37 | 39 | 38 | 39 |
| Ease of rinse (liters $H_2O$) | 1.3 | 1.0 | 0.8 | 1.7 | 1.2 | 1.4 | 2.2 | 2.0 | 1.7 |

The data show that organic solvents improve cleaning and that at a given level of solvent, the best cleaning performance is achieved with $C_{10}$ AS. In general, the higher the level of solvent the better the soap scum performance. The efficiency of $C_{10}$ AS means that lower levels of solvent can be used while still achieving better soap scum cleaning than for other AS chain lengths at higher solvent levels. The data also indicate that solvent can be used to adjust the amount of water needed to rinse the composition away. Low chain alkyl sulfates generate low levels of suds but are easy to rinse. Compositions with $C_{10}$ AS generate a higher level of suds but these are still easy to rinse. Compositions based on $C_{12}$ AS generate excessive suds and are more difficult to rinse; or, stated otherwise, a higher level of solvent is required for compositions based on $C_{12}$ AS to improve rinsing.

Effect of Solvent Type on Cleaning Performance and Suds Control

| | 2 | 14 | 15 | 10 | 11 | 16 | 17 |
|---|---|---|---|---|---|---|---|
| Ingredient | | | | | | | |
| $C_{10}$ alkyl sulfate** | 2.0 | 2.0 | 2.0 | 2.0 | 2.0 | 2.0 | 2.0 |
| Citric acid# | 3.0 | 3.0 | 3.0 | 3.0 | 3.0 | 3.0 | 3.0 |
| $NH_4OH$ | 0.16 | 0.16 | 0.16 | 0.16 | 0.16 | 0.16 | 0.16 |
| PnB† | — | 2.0 | 4.0 | — | — | — | — |
| DPnB†† | — | — | — | 2.0 | 4.0 | — | — |
| $C_4EO_2$††† | — | — | — | — | — | 2.0 | 4.0 |
| Perfume | 0.2 | 0.2 | 0.2 | 0.2 | 0.2 | 0.2 | 0.2 |
| Water | Bal. | Bal. | Bal. | Bal. | Bal. | Bal. | Bal. |
| Performance data | | | | | | | |
| Soap scum cleaning | 11 | 8 | 4 | 7 | 6 | 8 | 5 |
| Calcium chip test | 33 | 37 | 38 | 32 | 38 | 40 | 31 |
| Suds height (cm) | 1.1 | 0.7 | 0.8 | 0.5 | 0.5 | 0.5 | 0.5 |
| Ease of rinse (liters) | 1.733 | 1.4 | 1.5 | 1.2 | 1.4 | 1.3 | 1.3 |

Incorporation of organic solvent in the formulations comprising $C_{10}$ AS generally improves soap scum cleaning. Additionally, the solvent induces a significant reduction in suds level which generally translates into improved rinsing. Note that the suds level may simply be adjusted through choice of type and level of organic cleaning solvent.

Effect of Organic Acid and Type

| Ingredient | 18 | 19 | 2 | 20 | 21 | 22 |
|---|---|---|---|---|---|---|
| $C_{10}$ alkyl sulfate** | 2.0 | 2.0 | 2.0 | 3.0 | 1.0 | 1.0 |
| Citric acid# | — | 3.0 | 3.0 | — | — | |
| Glycolic acid## | — | — | — | — | 3.0 | — |
| DAGS### | — | — | — | — | — | 3.0 |
| $NH_4OH$ | — | — | 0.16 | 0.16 | 0.15 | 0.03 |
| DPnB†† | — | 2.0 | — | — | — | |
| Perfume | 0.2 | 0.2 | 0.2 | 0.2 | 0.2 | 0.2 |
| Water | Bal. | Bal. | Bal. | Bal. | Bal. | Bal. |

-continued

| Performance data | 18 | 19 | 2 | 20- | 21 | 22 |
|---|---|---|---|---|---|---|
| Soap scum cleaning | 50+ | 50+ | 11 | 7 | 14 | 14 |
| Calcium chip test (mg removal) | 2 | 1 | 33 | 40 | 66 | 52 |
| Ease of rinse (liters of $H_2O$) | 1.6 | 1.6 | 1.7 | 1.4 | 1.7 | 1.6 |

The data show that no cleaning is obtained in the absence of the organic acid, even in the presence of solvent. The organic acid also improves calcium carbonate removal on the calcium chip test. Additionally, improved cleaning can be achieved using higher levels of $C_{10}$ AS without the need for solvent (compare composition No. 20 with compositions No. 10 and 11). Finally, best cleaning results are achieved with citric acid though other acids such as glycolic acid or a mixture of adipic, succinic and glutaric acids also provide excellent results. Moreover, improved hard water removal is obtained using either the glycolic acid or the mixture of adipic, glutaric and succinic acids in spite of the fact that all compositions are at pH 3.

Effect of Thickening Polymer and Hydrophilic Polymer

| Ingredient | 23 | 24 | 25 | 26 |
|---|---|---|---|---|
| $C_{10}$ alkyl sulfate** | 1.75 | 2.0 | 2.0 | 3.0 |
| Citric acid# | 3.0 | 3.0 | 3.0 | 3.0 |
| $NH_4OH$ or NaOH to pH 3.0 | 0.2 | 0.2 | 0.2 | 0.2--- |
| DPnB†† | — | — | 1.0 | 1.75 |
| Xanthan gum$^{\alpha}$ | — | 0.35 | 0.35 | 0.35 |
| Polyvinyl pyrrolidone$^{\beta}$ | — | 0.1 | 0.1 | 0.1 |
| Perfume | 0.4 | 0.4 | 0.4 | 0.4 |
| Water | Bal. | Bal. | Bal. | Bal. |
| **Performance data** | **2** | **24** | **25** | **26** |
| Soap scum cleaning | 6 | 6 | 4 | 4 |
| Ease of rinse (liters of $H_2O$) | 1.7 | 2.0 | 1.7 | 1.4 |
| Brookfield viscosity (cP) | — | 155 | 155 | 155 |

Excellent cleaning performance is achieved in the context of a liquid thickened with xanthan gum. Rinsing requires more water due to the effect of the thickener, but can be reduced by incorporation of organic solvents into the composition.

The following low viscosity spray compositions were made according to the invention:

| | 27 | 28 | 29 | 30 | 31 |
|---|---|---|---|---|---|
| Ingredient | | | | | |
| Na $C_{10}$ alkyl sulfate** | 2.0 | 2.0 | 3.0 | 3.0 | 3.0 |
| Na $C_{12-14}$ alkyl sulfate**** | 0.25 | 0.25 | — | — | — |
| Citric acid# | 3.0 | 3.0 | 4.5 | 4.5 | — |
| DAGS## | — | — | — | — | 4.5 |
| $NH_4OH$ or NaOH to pH 3.0 | 0.30 | 0.30 | 0.45 | 0.45 | 0.05 |
| DPnB†† | 3.0 | 3.0 | 4.0 | 4.0 | 4.0 |
| Xanthan gum$^{\alpha}$ | — | 0.05 | — | 0.05 | 0.05 |
| Polyvinyl pyrrolidone$^{\beta}$ | 0.1 | 0.1 | 0.1 | 0.1 | 0.1 |
| Perfume | 0.2 | 0.2 | 0.2 | 0.2 | 0.2 |
| Water | Bal. | Bal. | Bal. | Bal | Bal. |

-continued

| | 27 | 28 | 29 | 30 | 31 |
|---|---|---|---|---|---|
| Performance data | | | | | |
| Soap scum cleaning | 6 | 6 | 4 | 4 | 5 |
| Calcium chip test (mg removal) | 45 | 40 | 55 | 45 | 50 |

Addition of low levels of gum to the compositions of the invention has a small negative effect on the calcium chip test, but does not affect soap scum cleaning. Polymeric gums can advantageously be used to increase product vertical cling and enhance suds stability, as well as to reduce product irritation when sprayed.

* Polystep B29 from Stepan Corporation

** Polystep B25 from Stepan Corporation

*** Sodium dodecyl sulfate from Aldrich Chemical

**** Stepanol WA extra from Stepan Corporation

† PnB: Propylene glycol n-butyl ether (Dow Chemical)

†† DPnB Di-propylene glycol n-butyl ether (Dow Chemical)

††† $C_4EO_2$: Butyl carbitol (Union Carbide)

50.5% solution of citric acid from Cargill Corporation

70% solution of glycolic acid made by DuPont Corporation and sold by Aldrich Chemical

100% active Refined dibasic acids (adipic, succinic, and adipic) from DuPont Corporation $^{\alpha}$ Xanthan gum sold under the Keltrol RD, manufactured and sold by Kelco corporation.

β PVP-K60 manufactured and sold by BASF AG.

What is claimed is:

1. An acidic hard surface cleaning composition comprising:

a) from about 1% to about 4.5% by weight of the composition of an alkyl sulfate surfactant the alkyl group containing about 10 carbon atoms on the average, with substantially al of the alkyl groups having within two carbon atoms of the 10 average carbon atoms;

b) from about 1% to about 6% by weight of the composition of one, or more, organic cleaning solvents;

c) from about 2% to about 6% by weight of the composition of citric acid; and d) from about 60% to about 90% by weight of the composition of an aqueous solvent system, said composition having a pH of from about 2 to about 5.

2. A composition according to claim 1 which comprises a) from about 1.2% to about 4% by weight of the composition of said alkyl sulfate detergent surfactant;

b) from about 3% to about 6% by weight of the composition of said one, or more, organic cleaning solvents;

c) from about 3% to about 5% by weight of the composition of said citric acid; and d) from about 60% to about 90% by weight of the composition of said aqueous solvent.

3. A composition according to claim 1 wherein, in said alkyl sulfate detergent surfactant, said alkyl group contains from about 8 to about 10 carbon atoms.

4. A composition according to claim 1 that additionally comprises from about 0.25% to about 4% by weight of the composition of an anionic cosurfactant selected from the group consisting of: $C_{12}$–$C_{18}$ paraffin sulfonates; $C_8$–$C_{18}$ alkyl ethoxy sulfates; and mixtures thereof.

5. A composition according to the claim 1 that additionally comprises from about 0.001% to about 0.1% hydrophilic polymer.

6. A composition according to the claim 5 that comprises from about 0.01% to about 0.20% of said hydrophilic polymer.

7. A composition according to the claim 5 wherein said hydrophilic polymer is selected from the group consisting of: polystyrene sulfonate; polyvinyl pyrrolidone; polyvinyl pyrrolidone/acrylate copolymer; polyvinyl pyridine; polyvinyl pyridine n-oxide; and mixtures thereof.

8. A composition according to claim 1 further comprising from about 0.05% to about 5% by weight of the composition of hydrogen peroxide.

9. A composition according to claim 8 further comprising at least an effective amount of one, or more, hydrophilic polymers selected from the group consisting of: polyvinyl pyrrolidone; polyvinyl pyrolidone/acrylate copolymer; polyvinyl pyridine; polyvinyl pyridine n-oxide; and mixtures thereof.

10. A composition according to claim 9 wherein said hydrophilic polymer is present at from about 0.001% to about 0.1% by weight of the composition.

11. A composition according to claim 10 wherein said hydrophilic polymer is present at from about 0.01% to about 0.05% by weight of the composition.

12. A composition according to claim 1 wherein said organic cleaning solvent is dipropylene glycol n-butyl ether.

13. A composition according to claim 12 containing citric acid as a pH adjuster and having a pH of about 3 or less.

14. A composition according to claim 1 wherein said polycarboxylic acid is selected from the group consisting of: citric acid and mixtures of succinic, adipic, glutaric acids, and mixtures thereof.

15. A composition according to claim 1 wherein said organic solvent is dipropylene glycol n-butyl ether and said polycarboxylic acid is citric acid.

16. An article of manufacture comprising the composition of claim 1 in a spray dispenser.

17. The article of manufacture of claim 16 wherein said spray dispenser comprises a trigger spray device and is capable of providing droplets with a weight average diameter of from about 10 to about 120 $\mu$m.

18. The process of cleaning a surface comprising applying an effective amount of the composition of claim 1 to said surface and rinsing said surface.

19. The method of claim 18 wherein said effective amount is applied onto said surface using a trigger-spray device.

20. The process of claim 19 wherein said surface is soiled with mildew and said composition contains an effective amount of hydrogen peroxide.

21. The process of claim 19 wherein said surface is soiled with mildew and said composition contains an effective amount of hydrophilic polymer.

* * * * *